US006910466B2

(12) United States Patent
Veinotte

(10) Patent No.: US 6,910,466 B2
(45) Date of Patent: Jun. 28, 2005

(54) ELASTOMERIC VAPOR FLOW CONTROL ACTUATOR WITH IMPROVED MECHANICAL ADVANTAGE

(75) Inventor: Andre Veinotte, Ontario (CA)

(73) Assignee: Siemens VDO Automotive Inc., Chatham (CA)

( * ) Notice: Subject to any disclaimer, the term of this patent is extended or adjusted under 35 U.S.C. 154(b) by 0 days.

(21) Appl. No.: 10/758,104

(22) Filed: Jan. 16, 2004

(65) Prior Publication Data

US 2004/0255914 A1 Dec. 23, 2004

Related U.S. Application Data

(60) Provisional application No. 60/440,864, filed on Jan. 17, 2003.

(51) Int. Cl.[7] ..... F02M 33/02

(52) U.S. Cl. ..... 123/520; 137/903

(58) Field of Search ..... 123/516, 518, 123/519, 520; 251/129.01, 129.15, 129.21, 4, 5, 331, 334, 339; 137/853, 903

(56) References Cited

U.S. PATENT DOCUMENTS 3,055,631 A 9/1962 Kippenhan
3,548,878 A * 12/1970 Brigandi ..... 137/636.1
3,740,019 A 6/1973 Kessell et al.
4,161,306 A 7/1979 Brune et al.
4,284,263 A 8/1981 Newcomb
5,217,037 A 6/1993 Bristol
5,285,805 A * 2/1994 Proper ..... 137/1
5,386,849 A 2/1995 Gilchrist et al.
6,026,847 A 2/2000 Reinicke et al.
2003/0107013 A1 6/2003 Pappo et al.

* cited by examiner

*Primary Examiner*—Thomas Moulis

(57) ABSTRACT

A canister purge valve for regulating fuel vapor flow between a fuel vapor collection canister and an intake manifold of an internal combustion engine. The canister purge valve includes a body having a wall defining a passage extending between a first port and a second port. The first port is adapted for fuel vapor communication with the fuel vapor collection canister. The second port is adapted for fuel vapor communication with the intake manifold of the internal combustion engine. An elastomeric actuator is at least partially disposed in the passage, and includes a first end, a second end spaced from the first end along a central axis, and a sealing surface between the first end and the second end. The sealing surface has a first diameter at a first portion and a second diameter at a second portion, the second diameter being wider than the first diameter. The elastomeric actuator is deformable between a first configuration that engages the wall to prohibit fuel vapor flow through the passage, and a second configuration space from the wall to permit fuel vapor flow through the passage.

10 Claims, 2 Drawing Sheets

ELASTOMERIC VAPOR FLOW CONTROL ACTUATOR WITH IMPROVED MECHANICAL ADVANTAGE

CROSS REFERENCE TO CO-PENDING APPLICATIONS

This application claims the benefit of the earlier filing date of U.S. Provisional Application No. 60/440,864, filed Jan. 17, 2003, the disclosure of which is incorporated by reference herein in its entirety.

FIELD OF THE INVENTION

This invention relates generally to on-board emission control systems for internal combustion engine powered motor vehicles, e.g., evaporative emission control systems, and more particularly to an emission control valve, such as a canister purge valve for an evaporative emission control system.

BACKGROUND OF THE INVENTION

A known on-board evaporative emission control system includes a vapor collection canister that collects fuel vapor emitted from a tank containing a volatile liquid fuel for the engine, and a canister purge solenoid (CPS) valve for periodically purging collected vapor to an intake manifold of the engine. The CPS valve in the known evaporative emission control system includes an electromagnetic solenoid that is under the control of a purge control signal generated by a microprocessor-based engine management system. The electromagnetic solenoid may be a digital on/off solenoid, or a proportional solenoid.

CPS valves that include a proportional solenoid are premium valves that use precision components to control the position of a flow restricting pintle. The position of the pintle is varied with the amount of current supplied to the solenoid. It is believed that known CPS valves that include a proportional solenoid have favorable response and control characteristics. However, known CPS valves that include a proportional solenoid suffer from a number of disadvantages, including high cost, as compared to valves having a lower parts count.

CPS valves that include a digital on/off solenoid have a low parts count and simple construction and are typically less costly than CPS valves that include a proportional solenoid. It is believed that known CPS valves that include a digital on/off solenoid have favorable response characteristics. However, known CPS valves that include a digital on/off solenoid suffer from a number of disadvantages, including poor control and high noise levels.

It is believed that there is a need for a CPS valve having the favorable response and control characteristics of a proportional solenoid valve, and the low manufacturing cost of a digital on/off solenoid valve.

SUMMARY OF THE INVENTION

In an embodiment, the invention provides a canister purge valve for regulating fuel vapor flow between a fuel vapor collection canister and an intake manifold of an internal combustion engine. The canister purge valve includes a body having a wall defining a passage between a first port and a second port. The first port may be adapted for fuel vapor communication with the fuel vapor collection canister, and the second port may be adapted for fuel vapor communication with the intake manifold. An elastomeric actuator is at least partially disposed in the passage. The elastomeric actuator includes a first end, a second end spaced from the first end along a central axis, and a sealing surface between the first end and the second end. The sealing surface has a first diameter at a first portion and a second diameter at a second portion, the second diameter being wider than the first diameter. The elastomeric actuator is deformable between a first configuration that engages the wall to prohibit fuel vapor flow through the passage, and a second configuration spaced from the wall to permit fuel vapor flow through the passage.

The first end, the second end, and the sealing surface of the elastomeric actuator may define a chamber having a first length along the central axis in the first configuration, and a second length along the central axis in the second configuration, such that the first length is shorter than the second length. The sealing surface contracts radially inward toward the central axis as the elastomeric actuator is deformed from the first configuration to the second configuration. The canister purge valve may include a stator, an electromagnetic coil, and an armature integrally formed with the elastomeric actuator at the first end. The second end of the elastomeric actuator is fixed with respect to the body. The elastomeric actuator may be deformable between the first configuration and the second configuration by energizing the electromagnetic coil to magnetically attract the armature toward the stator and deform the elastomeric actuator in the direction of the central axis. A stiffness of the elastomeric actuator increases as an ambient temperature decreases, and the electromagnetic coil may be energized to compensate for the increased stiffness.

In another embodiment, the invention provides a valve for regulating fluid flow. The valve includes a body having a wall defining a passage between a first port and a second port. The wall includes a portion disposed around, and parallel to, a central axis. An elastomeric actuator is at least partially disposed in the passage. The elastomeric actuator includes a first end, a second end spaced from the first end along the central axis, and a sealing surface between the first end and the second end. The elastomeric actuator is deformable between a first configuration that engages the wall to prohibit fluid flow through the passage, and a second configuration spaced from the wall to permit fluid flow through the passage.

In yet another embodiment, the invention provides a method of regulating fuel vapor flow between a fuel vapor collection canister and an intake manifold of an internal combustion engine, utilizing a canister purge valve. The valve includes a body having a wall defining a passage extending between a first port and a second port. The first port may be adapted for fuel vapor communication with the fuel vapor collection canister, and the second port may be adapted for fuel vapor communication with the intake manifold. The valve includes an elastomeric actuator at least partially disposed in the passage. The elastomeric actuator has a first end, a second end spaced from the first end along a central axis, and a sealing surface between the first end and the second end. The sealing surface has a first diameter at a first portion and a second diameter at a second portion, the second diameter being wider than the first diameter. The method includes engaging the wall with the elastomeric actuator to prohibit fuel vapor flow through the passage, and disengaging the elastomeric actuator from the wall to permit fuel vapor flow through the passage.

The disengaging the elastomeric actuator may include energizing an electromagnetic coil to magnetically attract an armature toward a stator in the direction of the central axis. The method may include energizing the electromagnetic coil to compensate for an increased stiffness of the elastomeric actuator as an ambient temperature decreases.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
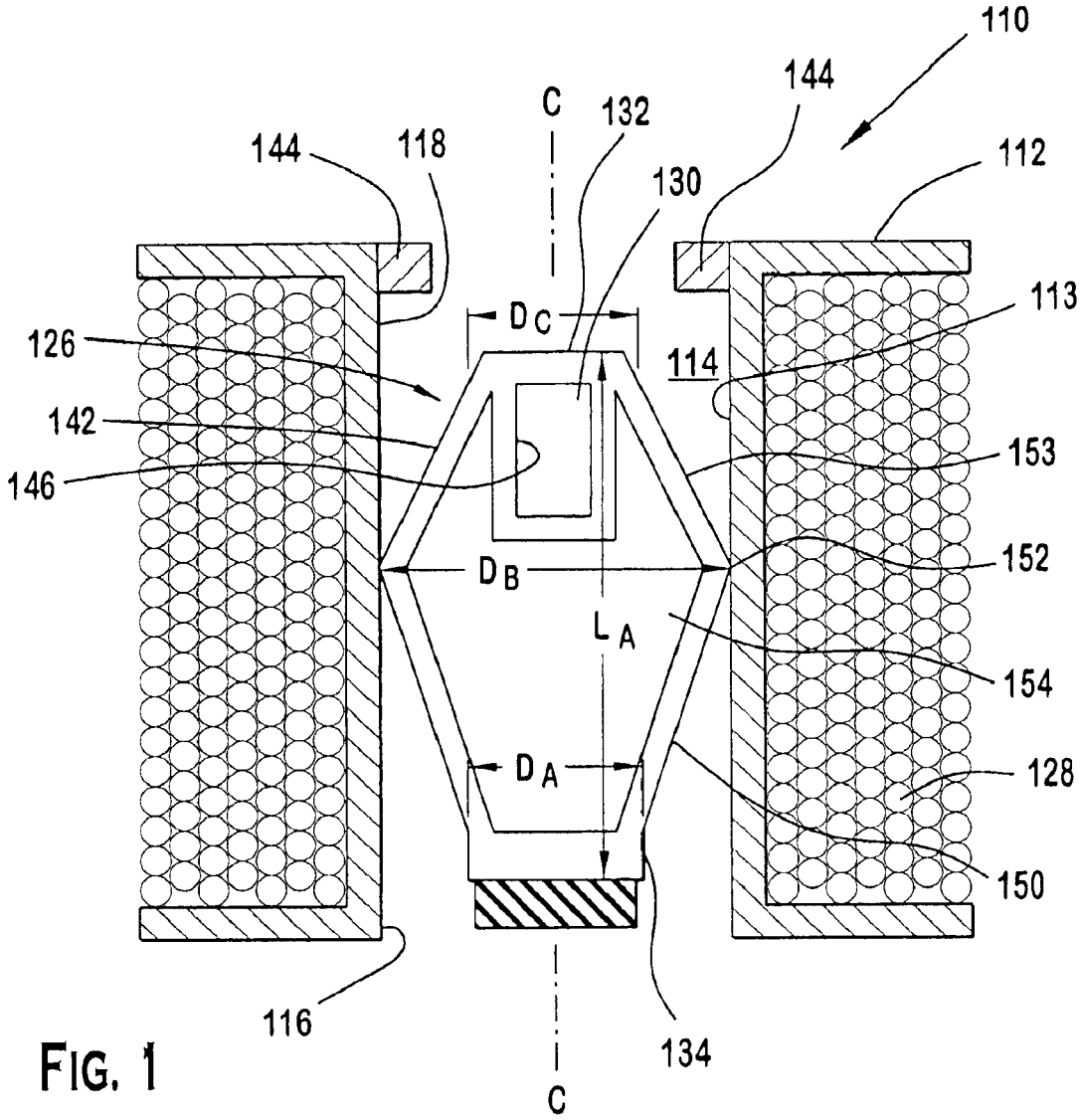
FIG. 1 is an apparatus for controlling flow with an elastomeric actuator having an improved mechanical advantage, in the closed configuration, according to an embodiment of the invention.

FIG. 1 illustrates a preferred embodiment of an apparatus for controlling flow with an elastomeric actuator having an improved mechanical advantage. In the preferred embodiment, apparatus 110 is a canister purge valve for regulating fuel vapor flow between a fuel vapor collection canister and an intake manifold of an internal combustion engine. Apparatus 110 includes a body 112, illustrated schematically in FIG. 1. Body 112 may be in the form of a known valve body. For example, body 112 may be a plastic injection-molded solenoid valve body, suitable for exposure to fuel vapor. Body 112 may include a wall 113 that defines a passage 114 extending between a first port 116 and a second port 118. The first port 116 may be adapted for fuel vapor communication with the fuel vapor collection canister (not shown). The second port 118 may be adapted for fuel vapor communication with the intake manifold of the internal combustion engine (also not shown). Preferably, passage 114 is circular at a cross-section perpendicular to a central axis C—C.

Apparatus 110 includes an actuator 126 at least partially disposed in the passage 114. Actuator 126 is formed of an elastomeric material, for example rubber. The elastomeric actuator 126 includes a first end 132, a second end 134 spaced from the first end 132 along central axis C—C, and a sealing surface 142 extending between first end 132 and second end 134. The sealing surface 142 has a first portion 150, a second portion 152 and a third portion 153. The sealing surface 142 has a first diameter $D_A$ at a lower end of first portion 150, a second diameter $D_B$ at the second portion 152, and a third diameter $D_C$ at an upper end of third portion 153, such that the second diameter $D_B$ is wider than the first diameter $D_A$ and the third diameter $D_C$. As shown in FIG. 1, first portion 150 and second portion 153 are each in the form of a frustrum, the base of the frustrums meeting at the second portion 152. However, first portion 150 and third portion 153 may be of any suitable shape, as long as diameter $D_B$ is wider than the first diameter $D_A$ and the third diameter $D_C$. For example, first portion 150 and third portion 153 may include a complex curvature, or first portion 150 and third portion 153 may include stepped portions or curves having discontinuities. The first end 132, the second end 134, and the sealing surface 142 form a chamber 154 within elastomeric actuator 126.

An armature 130, formed of a ferrous material, may be integrally formed with elastomeric actuator 126 at the first end 132. As shown in FIG. 1, the elastomeric actuator 126 is formed around armature 130 such that armature 130 is disposed in a cylinder-shaped void 146 in elastomeric actuator 126. Armature 130 may be integrally formed with the elastomeric actuator 126 at the first end 132 in other ways, as long as armature 130 is sufficiently connected to first end 132 so that the elastomeric actuator 126 deforms when the armature 130 is subjected to a motive force, as described below. For example, armature 130 may be attached to the first end 132 with an adhesive, or armature 130 may be attached to first end 132 with a connector member. The second end 134 of the elastomeric actuator 126 may be fixed to the body 112, as is illustrated schematicallly in FIG. 1. Second end 134 may be fixed to body 112 via a support member (not shown) attached to wall 113. The support member may be formed of any suitable shape, as long as second end 134 can be attached to the support member, and the support member permits fuel vapor flow through passage 114, as described below. For example, the support member may be formed of two crossed beams that provide four points for attachment to wall 113, while also providing four paths for vapor flow.

Figure 2:
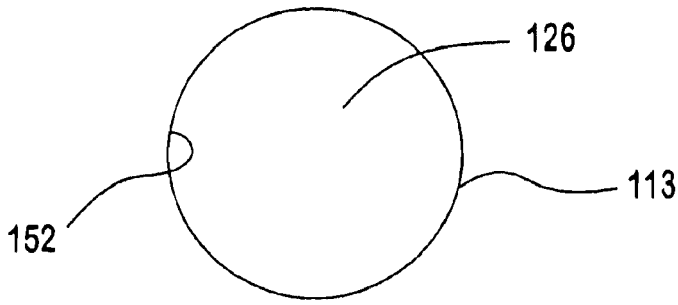
FIG. 2 is a top view of the apparatus of FIG. 1.

The elastomeric actuator 126 is elastically deformable between a first configuration and a second configuration. FIGS. 1 and 2 show the elastomeric actuator 126 in the first configuration wherein the second portion 152 matingly engages the wall 113, prohibiting fuel vapor flow through the passage 114. In the first configuration, elastomeric actuator 126 has a first length $L_A$.

Figure 3:
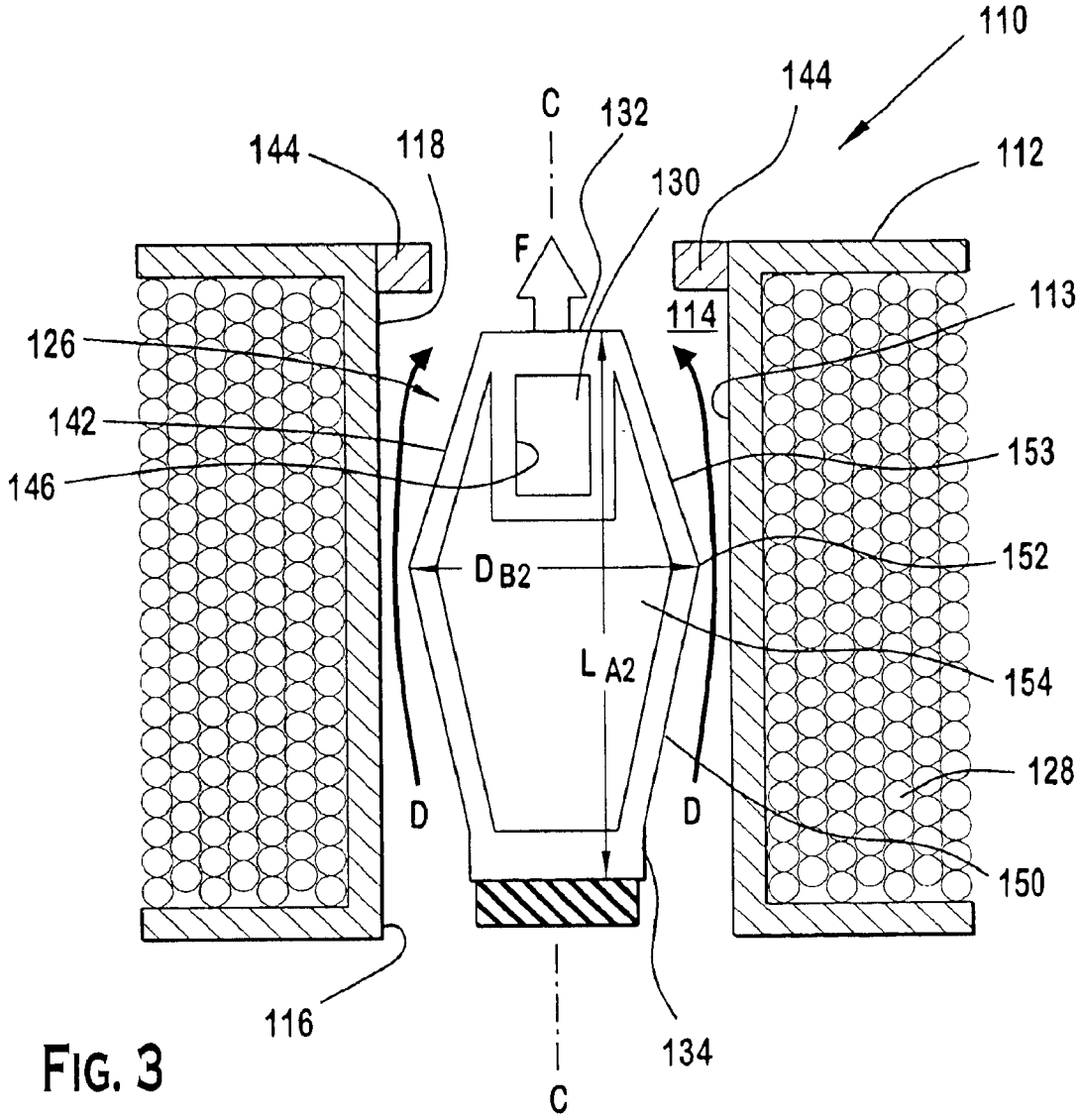
FIG. 3 is the apparatus of FIG. 1 in the open configuration.
Figure 4:
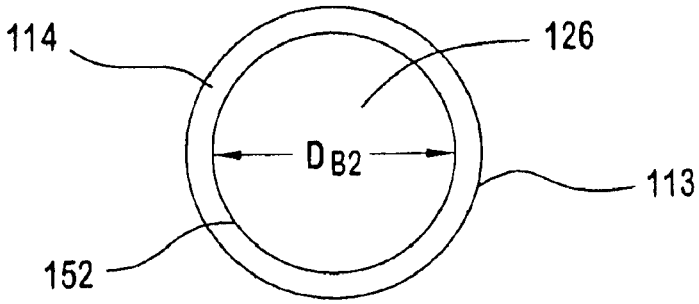
FIG. 4 is a top view of the apparatus of FIG. 3.

As described above, actuator 126 is formed of an elastomeric material, and in a preferred embodiment, actuator 126 is formed of rubber. So when the elastomeric actuator 126 is subjected to an axial tensile force F, as shown in FIG. 3, the elastomeric actuator 126 deforms to the second configuration such that the length $L_A$ increases to $L_{A2}$, and the diameter $D_B$ decreases to $D_{B2}$. The force F required to deform the elastomeric actuator 126 can be small due to the mechanical advantage of the elastomeric actuator 126. The diameter $D_A$ of the first portion 150 and the diameter $D_C$ of the third portion 153 being smaller than the diameter $D_B$ of second portion 152, enables a reduction in the amount of elastomeric material required to be deformed by the force F, as compared to an elastomeric actuator having a constant diameter throughout the length of the actuator. The chamber 154 also enables a reduction in the amount of elastomeric material required to be deformed by the force F, as compared to a solid elastomeric actuator. The decrease in the diameter of the elastomeric actuator 126 at the second portion 152 from $D_B$ to $D_{B2}$ breaks the vapor seal between the sealing surface 142 and the wall 113, thus permitting fuel vapor flow through the passage 114 in the direction of arrows D,D. FIG. 4 shows elastomeric actuator 126 deformed to the second configuration such that the diameter $D_B$ at second portion 152 decreases to $D_{B2}$, breaking the vapor seal between sealing surface 142 and wall 113, to form a flow path through passage 114.

Apparatus 110 may include an electromagnetic coil 128 and a stator 144. In a preferred embodiment, the axial tensile force F is created by energizing the electromagnetic coil 128 to produce a magnetic force that attracts the armature 130, formed integrally with elastomeric actuator 126 at the first end 132, to the stator 144. With the second end 134 of the elastomeric actuator 126 fixed to the body 112, the elastomeric actuator 126 is deformed from the first configuration to the second configuration, permitting fuel vapor flow through the passage 114. The elastomeric actuator 126 returns to the first configuration when the electromagnetic coil 128 is de-energized, prohibiting fuel vapor flow through the passage 114. The amount of vapor flow through passage 114 may be increased by increasing the force F generated by the magnetic coil 128, and the amount of vapor flow through passage 114 may be decreased by decreasing the force F generated by the magnetic coil 128.

The material forming the elastomeric actuator 126 may possess a stiffness property that changes with a change in ambient conditions, such as a change in ambient temperature. As the ambient temperature decreases, the stiffness of the elastomeric actuator 126 may increase, thus requiring a stronger axial tensile force F to achieve a desired reduction in the diameter $D_B$ of the elastomeric actuator 126. Moreover, the coil 28 may have a higher resistance in the decreased ambient temperature. Thus, the preferred embodiment has a sensor to measure the ambient temperature, and a control circuit to adjust the control signal to the coil 128, generate a proper magnetic force, and achieve a desired reduction in the diameter $D_B$ of the elastomeric actuator 126.

The preferred embodiment provides numerous advantages. For example, the preferred embodiment provides a CPS valve having the favorable response and control characteristics of a proportional solenoid valve, and the low manufacturing cost of a digital on/off solenoid valve. The preferred embodiment provides a CPS valve having an elastomeric actuator with an improved mechanical advantage. The preferred embodiment provides a CPS valve having a reduced number of parts. For example, the valve achieves a vapor seal directly between the actuator and the passage wall, rather than between an additional closure member and seat, as in known valves. Moreover, the valve does not require precision alignment along the flow axis between a seat and a closure member, thus simplifying the design and manufacturing processes.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A canister purge valve for regulating fuel vapor flow between a fuel vapor collection canister and an intake manifold of an internal combustion engine, the canister purge valve comprising:

a body having a wall defining a passage between a first port and a second port, the first port adapted for fuel vapor communication with the fuel vapor collection canister, and the second port adapted for fuel vapor communication with the intake manifold of the internal combustion engine;

an elastomeric actuator at least partially disposed in the passage;

wherein the elastomeric actuator includes a first end, a second end spaced from the first end along a central axis, and a sealing surface between the first end and the second end, the sealing surface having a first diameter at a first portion and a second diameter at a second portion, the second diameter being wider than the first diameter, the elastomeric actuator being deformable between a first configuration that engages the wall to prohibit fuel vapor flow through the passage, and a second configuration spaced from the wall to permit fuel vapor flow through the passage.

2. The canister purge valve of claim 1, wherein the first end, the second end, and the sealing surface of the elastomeric actuator define a chamber, the chamber having a first length along the central axis in the first configuration, the chamber having a second length along the central axis in the second configuration, the first length being shorter than the second length.

3. The canister purge valve of claim 2, wherein the sealing surface contracts radially inward toward the central axis as the elastomeric actuator is deformed from the first configuration to the second configuration.

4. The canister purge valve of claim 1, further comprising:

a stator;

an electromagnetic coil; and an armature integrally formed with the elastomeric actuator proximate the first end.

5. The canister purge valve of claim 4, wherein the second end of the elastomeric actuator is fixed with respect to the body; and wherein the elastomeric actuator is deformable between the first configuration and the second configuration by energizing the electromagnetic coil to magnetically attract the armature toward the stator and deform the elastomeric actuator in the direction of the central axis.

6. The canister purge valve of claim 5, wherein a stiffness of the elastomeric actuator increases as an ambient temperature decreases; and wherein the electromagnetic coil is energized to compensate for the increased stiffness.

7. A valve for regulating fluid flow, comprising:

a body having a wall defining a passage between a first port and a second port, the wall having a portion disposed around, and parallel to, a central axis; and an elastomeric actuator at least partially disposed in the passage;

wherein the elastomeric actuator includes a first end, a second end spaced from the first end along the central axis, and a sealing surface between the first end and the second end, the sealing surface having a first diameter at a first portion and a second diameter at a second portion, the second diameter being wider than the first diameter, the elastomeric actuator being deformable between a first configuration that engages the wall to prohibit fluid flow through the passage, and a second configuration spaced from the wall to permit fluid flow through the passage.

8. A method of regulating fuel vapor flow between a fuel vapor collection canister and an intake manifold of an internal combustion engine, utilizing a canister purge valve, the valve including a body having a wall defining a passage extending between a first port and a second port, the first port, adapted for fuel vapor communication with the fuel vapor collection canister, and the second port adapted for fuel vapor communication with the intake manifold of the internal combustion engine, the valve including an elastomeric actuator at least partially disposed in the passage, the elastomeric actuator having a first end, a second end spaced from the first end along a central axis, and a sealing surface between the first end and the second end, the sealing surface having a first diameter at a first portion and a second diameter at a second portion, the second diameter being wider than the first diameter, the method comprising:

engaging the wall with the elastomeric actuator to prohibit fuel vapor flow through the passage; and disengaging the elastomeric actuator from the wall to permit fuel vapor flow through the passage.

9. The method of claim 8, wherein the disengaging the elastomeric actuator includes energizing an electromagnetic coil to magnetically attract an armature toward a stator in the direction of the central axis.

10. The method of claim 9, further comprising energizing the electromagnetic coil to compensate for an increased stiffness of the elastomeric actuator as an ambient temperature decreases.

* * * * *